US005270698A

United States Patent [19]

Hoyle et al.

[11] Patent Number: 5,270,698

[45] Date of Patent: Dec. 14, 1993

[54] EMERGENCY SIGNALING DEVICE

[76] Inventors: Patrick D. Hoyle, 513 E. Alder, Sedro Woolley, Wash. 98289; Richard A. Bishel, 2618 R Ave., Apt. B, Anacortes, Wash. 98221

[21] Appl. No.: 747,801

[22] Filed: Aug. 19, 1991

Related U.S. Application Data

[63] Continuation-in-part of Ser. No. 621,764, Dec. 3, 1990.

[51] Int. Cl.[5] ..... G08B 5/00

[52] U.S. Cl. ..... 340/815.01; 340/815.15; 340/815.2; 40/902

[58] Field of Search ..... 340/815.01, 815.03, 340/815.15, 815.2, 815.21, 815.22, 815.3, 331, 332; 40/442, 902; 362/184

[56] References Cited

U.S. PATENT DOCUMENTS 1,500,706 7/1924 Isom .
2,202,188 5/1940 Cianchi .
2,429,363 10/1947 McLaren .
3,631,318 12/1971 Hubbard .
4,047,165 9/1977 Andreasson .
4,177,408 12/1979 Mason .
4,212,003 7/1980 Mishoe et al. .
4,254,405 3/1981 Wenzlaff .
4,276,542 6/1981 Russ .
4,287,509 9/1981 Beggs .
4,305,070 12/1981 Samuel .
4,532,498 7/1985 Gilmore .
4,556,863 12/1985 Devitt et al. .
4,682,147 7/1987 Bowman .
4,730,184 3/1988 Bach .
4,820,956 4/1989 Slobodzian et al. .
4,839,630 6/1989 Miller .
4,855,723 8/1989 Fritz et al. .
4,901,461 2/1990 Edwards et al. .
4,929,936 5/1990 Friedman et al. .

*Primary Examiner*—Ulysses Weldon
*Assistant Examiner*—M. Fatahiyar
*Attorney, Agent, or Firm*—Hughes & Multer

[57] ABSTRACT

A switching device for flashing an installed light fixture, as for helping emergency response personnel locate a dwelling. A switch housing which is mountable within a conventional junction box encloses a switch having "off", "on", and "flash" positions. In the "flash" position, the switch cyclically completes and interrupts the installed 120 volt AC circuit so that the light fixture flashes on and off. A triac is employed as a relay for completing the circuit, and a timer-controlled driver portion is provided for actuating the triac. The triac driver actuates the triac at the beginning of each half-cycle of the AC current, in response to a low-voltage pulse which passes through a capacitor connected to the high-voltage lead. The timer may be a 555 IC timer, and a conversion network may be provided for supplying DC current for this. A piezoelectric element is also provided for generating an audible signal indicating that the "flash" mode has been actuated. The duty cycle of the device can be adjusted as desired, to provide anything from long-term illumination of the bulb to a short flash.

29 Claims, 7 Drawing Sheets

IC1
555
P1
P2
P3
P4
P6
P7
P8
R1
R2
R3
R4
R5
R6
R2'
R3'
C1
C2
C3
C3'
D1
D2
D3
D4
D5
D7
94
98
98d
100
102
104
106
108
110
111
113
120
121
126
132
136
140
156
158
160
16a
16c
16d
14
48
79
84
204
206
207
208
209
210
211
220
222
223
224
226
229
230
232
250
252a
252b
256
73'
74'
75'

EMERGENCY SIGNALING DEVICE

RELATED APPLICATIONS

This is a continuation-in-part application of copending application Ser. No. 07/621,764 filed Dec. 3, 1990.

FIELD OF THE INVENTION

This invention relates to a switch for automatically turning an electric light on-and-off, and more particularly, to a device for flashing an exterior house light to draw the attention of emergency response personnel to the house.

BACKGROUND OF THE INVENTION

Identification of houses by personnel responding to emergency calls has been a long-standing problem. House numbers are frequently attached to the house itself, and these are consequently often difficult to see from a distance or from a passing vehicle. This problem is particularly pronounced at night, when even a prominent house number may be difficult or impossible to see. Consequently, emergency service personnel such as ambulance drivers, firemen, or policemen often lose precious minutes in identifying the proper home during an emergency.

A number of devices have been proposed for identifying or drawing attention to a structure in an emergency. Predominantly, these have taken the form of dedicated systems which serve no other function apart from that of providing an emergency signal. Among such systems are those which are disclosed in the following U.S. patents,

| U.S. Pat. No. | Patentee | Issue Date |
|---|---|---|
| 4,901,461 | Edwards et al. | February 20, 1990 |
| 4,855,723 | Fritz et al. | August 8, 1989 |
| 4,839,630 | Miller | June 13, 1989 |
| 4,532,498 | Gilmore | July 30, 1985 |
| 4,305,070 | Samuel | December 8, 1981 |
| 4,212,003 | Mishoe et al. | July 8, 1980 |
| 4,047,165 | Andreasson | September 6, 1977 |
| 2,429,363 | McLaren | October 21, 1947 |
| 1,500,706 | Isom | July 8, 1924 |

Because they are all dedicated systems, these devices share a number of disadvantages for use in a residential environment due to their expense and the need for special display fixtures, mounting, and wiring. For example, the device disclosed by Edwards et al. requires a bulky display unit 10 which is mounted to the exterior of the house, a special power pack and control unit 30, and lengths of electrical cord to connect these assemblies together and to a wall socket. Not only are these separate assemblies expensive, but their installation is necessarily inconvenient and results in electrical cords being strung about the house. Similarly, Fritz et al. require a complex and bulky exterior alarm unit 13, plus an internal master control unit 15 which is connected to an exterior alarm unit via an electrical cord, as well as a transmitter unit 17 for activating the alarm unit. Likewise, Miller shows an external alarm unit having an a)arm light and horn, a master unit box, a power cord, etc.

The remaining references cited above disclose other dedicated alarm devices. Gilmore shows a burglar alarm system having a special camouflaged external alarm sign; Samuel shows a burglar alarm system which is connected to the horn of an automobile; Mishoe et. al. show another system having a disguised sign which, when activated, illuminates a warning message and stroboscopic lamps; Andreasson shows a battery powered emergency signaling device which can be stuck to the inside of a window; McLaren shows an alarm system for a refrigeration system which sounds a bell and extends a warning sign; Isom shows an alarm system having an external fixture which unrolls a banner bearing a warning signal, activates lights to illuminate the banner, and sounds an alarm bell.

Inasmuch as the above-described systems involve the use of dedicated equipment having the sole function of providing an alarm signal, they share the disadvantages of unnecessary expense and difficulty of installation in a residential environment. Many of these drawbacks could be avoided by making use of a pre-existing system having some other primary function, with the alarm function being provided as a secondary function for use in an emergency. In this respect, a great majority of residential dwellings are provided with conventional porch lights which have the primary function of illuminating the entrance of the house which faces the street, and these are clearly visible to passing personnel. Also, the porch light frequently serves to illuminate the house number so that it can be read from the street. One attempt which has been made to utilize such porch lights to serve an alarm function is that disclosed in U.S. Pat. No. 4,730,184 (issued Mar. 8, 1988 to Bach), which shows an alarm assembly 80 which screws into a conventional porch light receptacle 89. The device consists of a sound generating assembly 82 which screws directly into the receptacle and a light bulb 83 which screws into a second receptacle Which is provided in the sound generating assembly. A "flasher unit" which periodically interrupts the flow of current therethrough is inserted in each of the receptacles, consequently causing the sound generating portion to pulsate, and the light bulb to flash on-and-off, whenever the porch light switch is turned on. A significant drawback of this device, of course, is the fact that once it has been installed in the porch light socket, this fixture can no longer be used as a conventional porch light to illuminate the porch area, which was the primary purpose for which it was originally installed.

Another, more sophisticated device which has been proposed for flashing the porch light of a house in a danger situation is that disclosed in U.S. Pat. No. 4,556,863 (issued Dec. 3, 1985 to Devitt et al.). This shows a switch device which is designed to be installed in a switch box in place of a conventional on/off switch, for the purpose of allowing a porch light to be flashed continuously on and off, as well as for permitting the light to be turned on and off in a conventional manner. Although this general approach is quite desirable from the standpoint of economy and convenience of installation, the actual switching circuitry taught by the Devitt patent encumbers the device with several serious drawbacks. This device employs a power switcher which is periodically enabled and disabled by an oscillator, with DC power for operating these components being stored in a capacitor 71 which charges up only during those intervals When the power switcher is not conducting. This is because the switcher acts as a short circuit in parallel with the supply to the capacitor during the period it is conducting, causing the main current to bypass the supply; but, during this same period the capacitor is discharging in order to supply power to the oscillator and buffer circuits to keep the switcher actuated. The light bulb can thus only be kept on until the energy stored in the capacitor has been used up, at which point the main light bulb must be switched off so that the capacitor can be charged up again. Since the current to charge up the capacitor must flow through a step-down resistor 69, the resistor will tend to overheat if this flow of current is very great. Consequently, the impedence of this resistor must be kept relatively high in order to keep the flow of current relatively low, but the net effect of this is that the charge-up rate of the capacitor is also kept very slow, and then the capacitor discharges relatively quickly when keeping the power switcher actuated. As a result, the Devitt device can only operate on a very limited duty cycle when flashing the porch light: this duty cycle (i.e., the ratio of the time interval the load is on to the sum of the intervals during which the load is on and off) may only be about 10–20%, and the practical affect of this is that the porch light is turned on for only short, dim flashes, which may be inadequate to effectively draw the attention of emergency response personnel to the house, or to illuminate address numbers so that they can be verified. Incidentally, if one were to attempt to overcome this deficiency by employing a resistor which would permit current to flow through it at a rate sufficient to significantly increase the duty cycle of the Devitt device (without the resistor overheating), this would necessitate use of a much larger resistor (e.g., on the order of 2 inches in height), which would tend to make it difficult or impossible to build the switching device so that it could fit in a conventional junction box.

Accordingly, there exists a need for an inexpensive and effective system for drawing attention to a residence or other building in which an emergency situation exists, and which selectively provides this alarm function by flashing a conventional porch light or the like on-and-off, yet which permits that light to selectively function in its normal on/off modes as well. Furthermore, there exists a need for such a device which flashes the light on-and-off with a sufficient duty cycle that it provides an effective emergency signal, as well as adequate illumination of the building entrance and its associated address numerals to permit these to be clearly observed by emergency response personnel.

SUMMARY OF THE INVENTION

The present invention has solved the problems cited above, and comprises generally an emergency signaling device which is mountable in the installed high-voltage AC circuit of a dwelling so as to selectively switch an exterior light of the dwelling to "on", "off", or "flash" modes. A switch housing is provided which is mountable in a light switch junction box within the interior of the dwelling, with a switch being mounted to the housing and having a "flash", "on", and "off" positions.

There is a primary relay mounted in the housing, and this is connected in one of the leads of the high-voltage circuit for selectively permitting current to flow therethrough in response to actuation of the relay by a gate current pulse. The relay may be a triac, and this is configured to remain actuated after the gate current pulse is terminated, so long as a minimum current is applied across the high-voltage lead in which it is installed.

A control circuit is provided for selectively providing the gate current pulses to the relay, and this control circuit may comprise a relay driver portion which initiates the gate current pulses in response to pulses of a relatively low voltage control current which are received by it. A timer portion cyclically enables the low voltage control current pulses to flow to the relay driver portion, this relatively low voltage control current having been reduced from the high voltage AC current by a voltage-reduction component, such as a capacitor or resistor. This voltage-reduction component is selectively connectable to the high-voltage AC lead in parallel with the main relay, so that at the beginning of each half cycle of the high-voltage AC current, the low voltage control current pulse passes through this to the relay driver portion of the circuit. If a capacitor is employed to reduce the voltage, the current lead effect of the capacitor permits the control current pulse to pass through it prior to the voltage of the main AC current exceeding a predetermined maximum, this maximum voltage being significantly less than that to which the control current would correspond in the absence of such a current lead effect. Then, when the relay driver portion initiates the gate current pulse in response to receiving the control current pulse, the primary relay is activated and permits the high-voltage AC current to flow therethrough to illuminate the light bulb. This grounds out the capacitor which is connected in parallel with the relay, so that the control current pulse is then terminated; however, the relay remains actuated by the current which is flowing the high-voltage lead for the remainder of the half cycle, until this passes through zero at the end of the half cycle. This process is repeated at the beginning of the next half-cycle, so that the control circuit in essence "steals" a relatively small pulse of energy at the beginning of each half-cycle of the 60 Hz AC current, and uses this small pulse to actuate the main relay for the remainder of the half-cycle. A portion of each of these small pulses of energy is also stored by a second capacitor, which supplies the energy to operate the timer portion of the control circuit. Because the main light bulb thus does not have to be shut off in order for energy to be collected to power the timer and relay, the switching device can be set to operate on whatever duty cycle is desired.

In operation, selection of the "flash" position of the switch connects the voltage-reduction component (i.e., the capacitor or resistor) to the first current lead, so that the low-voltage control current flows to the timer portion of the control circuit. In response to this, the timer portion permits the gate current pulses to flow to the relay (as previously described), for a first predetermined period of time, and then prevents the flow of these pulses for a second predetermined period of time, with the result that the exterior light fixture periodically flashes on and off. There are also means responsive to selection of the "on" position of the switch for connecting the lead to the light fixture so that it remains continuously lit, as well as means responsive to selection of the "off" position for disconnecting the lead from the fixture so that it remains unlit.

The control circuit may further be provided with a convertor network for converting the low-voltage control current pulses from AC current to DC current, and this convertor network may be a diode array. Also, in those embodiments where a capacitor is used to step down the supply current, there may be a relatively low resistance resistor connected in series with this capacitor so as to eliminate voltage spikes which might otherwise pass therethrough and damage the control circuit.

The timer portion of the control circuit may be a 555 IC timer configured to operate in an astable mode. The relay driver portion of the control circuit may be a optoisolator having an internal LED which is actuated by each of the control pulses which flow to the optoisolator; the optoisolator has an internal triac which is actuated in response to actuation of the LED, and this internal triac is connected to the primary triac so as to provide the gate current pulse thereto in response to each such actuation. The first lead of the internal LED of the optoisolator may be connected to the supply capacitor, with the second lead being connected to the output pin of the 555 IC timer, so that when the output pin of the timer shifts to its low state, the control current pulses are permitted to flow through the optoisolator and actuate the internal LED; then, when the output pin cycles to its high state, the control current pulses cease to flow to the optoisolator, so that the main triac becomes deactivated and the main light bulb goes out.

The device may further be provided with means for generating an audible signal in response to selection of the flash mode of the switch, indicating to an operator that the light fixture is being flashed on and off to draw the attention of emergency response personnel to the dwelling. This may be a piezoelectric element connected to the capacitor (or other voltage-reduction component) so that the current flowing through the capacitor energizes the element. A second timer may be provided for cyclically permitting the low voltage current to flow through the piezoelectric element, so that the element is cyclically actuated to emit its audible signal. This second timer may be a second 555 IC timer. Alternatively, this second timer and the timer Portion of the main control circuit may each be one-half of a single 556 IC timer, each half of this timer being configured to operate independently of the other in an astable mode. A secondary capacitor may be connected across the output of the main capacitor, or across the output of the diode array or other convertor network, for storing a portion of the energy of each pulse of low voltage current which flows therethrough, this secondary capacitor further being connected across the supply voltage and ground pins of the second timer for supplying stored energy which operates the second timer.

Other features and advantages of the present invention will become apparent from a study of the following description and the accompanying drawings, which are merely descriptive of the present invention.

DETAILED DESCRIPTION OF THE INVENTION

Figure 1:
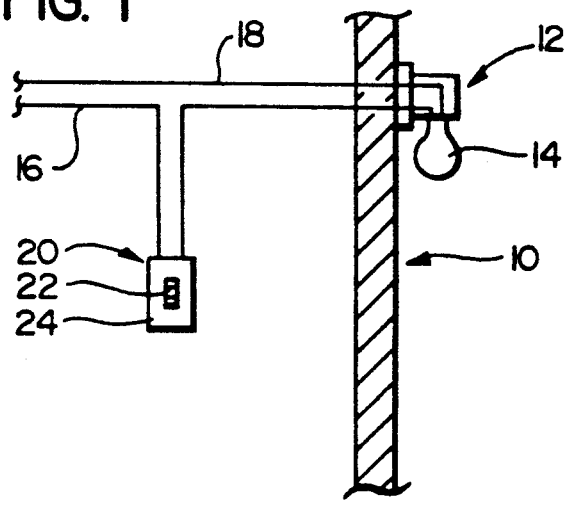
FIG. 1 shows a porch light mounted to the exterior of a building and a switch unit incorporating the present invention mounted in the pre-existing electrical circuit for the light fixture.

FIG. 1 shows a dwelling or other structure 10 having a conventional exterior porch light fixture 12. The light bulb 14 of fixture 12 is powered by conventional 120 volt 60 Hz AC household electrical current which is applied across first and second electrical leads 16 and 18. Mounted in lead 16, so as to control the passage of current therethrough, is a switch assembly 20 which incorporates the present invention, this switch assembly having a lever or rocker 22 by which an operator can select one of three positions, "on", "off", or "flash". In the "on" position, the porch light is continuously lit, serving its primary function of illuminating the porch and entryway of the house 10; similarly, when switch 20 is in the "off" position, power to porch light fixture 12 is secured so that light bulb 14 remains dark. When the "flash" position is selected by the occupant of house 10 in response to an emergency, however, switch assembly 20 effects a periodic flow of current through lead 16, causing light bulb 14 of porch light fixture 12 to flash on-and-off in a manner which will draw the attention of emergency response personnel to house 10 and thus facilitate a rapid response to the emergency situation. In many installations, the bulb will also illuminate the street numbers of the house if these are positioned relatively near the bulb, so that the emergency response personnel can verify that they are at the correct address.

Switch assembly 20 is configured so that it can be installed in a standard-sized light switch junction box in place of a conventional "on-off" wall switch, and then covered by a switch cover plate 24, thereby making for an easy and neat installation and eliminating the need for separate warning units, control units, connecting electrical cords, and the like, as are employed in the previously-proposed devices discussed above.

Figure 2:
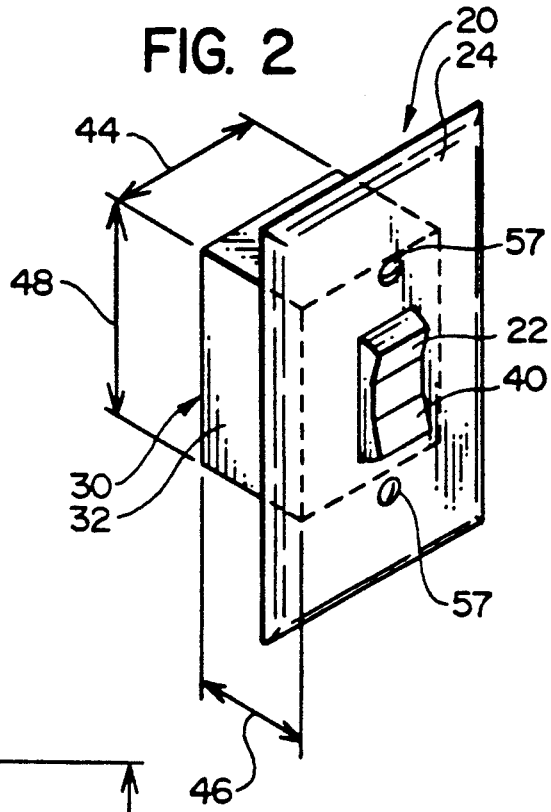
FIG. 2 shows a perspective view of the switch unit of FIG. 1.
Figure 3:
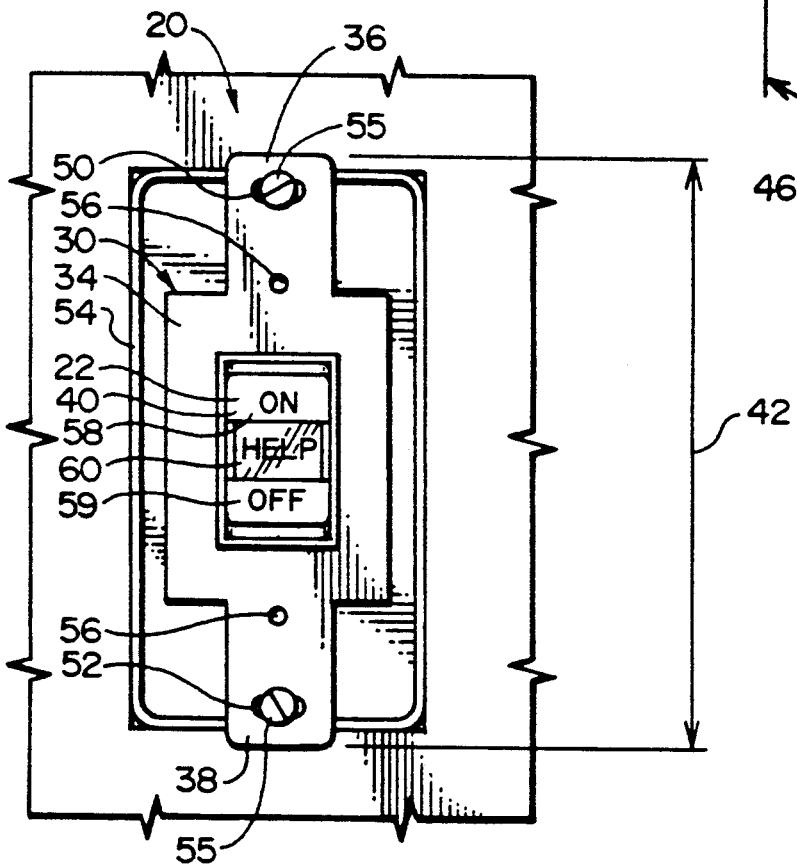
FIG. 3 shows a front elevational view of the switch unit of FIGS. 1–2, with the cover plate removed to show the unit mounted in a conventional light switch junction box.

FIGS. 2 and 3 show switch enclosure 30, which encloses the switch mechanism and circuit of switch assembly 20. Enclosure 30 comprises generally a rectangular insulating housing 32, a face plate 34 (see FIG. 3), from which first and second mounting brackets 36, 38 project longitudinally, and a three-position rocker switch 40. As noted above, switch assembly 20 is configured and sized to be mounted in a standard-sized junction box provided for a wall mount light switch, and, for example, such standard-sized junction boxes typically have interior dimensions of approximately 2 inches wide by 4 inches long by 2 inches deep. Mounting brackets 36 and 38 are pierced by elongated screw holes 50 and 52, which are sized and configured so that when enclosure 30 is placed within standard-sized switch box 54, these line up with the threaded holes which are conventionally provided therein for the mounting of conventional light switches, so that enclosure 30 can be secured therein by screws 55. Face plate 34 is in turn provided with a pair of threaded holes 56, which are configured so that face plate 24 can be mounted thereto by means of screws 57. The back of housing 32 is provided with a pair of conventional connectors (not shown). such as, for example, conventional screw-type connections, butt-type connections, or wire leads so that switch assembly 20 can be electrically connected in lead 16.

Rocker switch 40 can be manually operated to select one of three positions "on", "off", or "flash". To facilitate its operation, a suitable legend is provided on the outwardly facing surface of the rocker switch; as shown in FIG. 3, the end portions 58, 59 may display the words "on" and "off", and the middle position 60 the word "help". The middle portion or panel 60 may preferably be translucent so that, as will be described below, a flashing light (e.g., an LED or small neon light bulb) mounted within the interior of case 32 can shine therethrough to provide a visual indication that the "help" position has been selected and activated.

Figure 4:
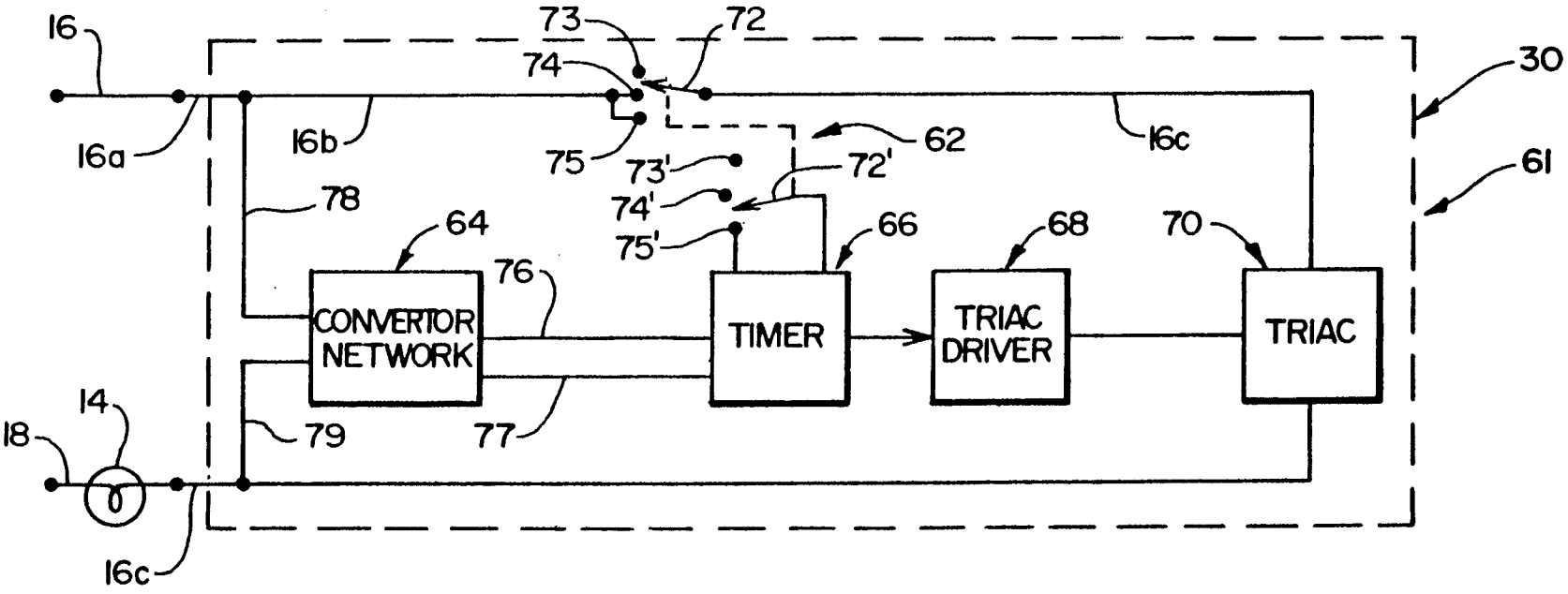
FIG. 4 shows block diagram of an electrical circuit incorporating the present invention.

Having provided an overview of the system of the present invention, the electrical circuits employed therein will now be described. FIG. 4 shows a block diagram of the flasher system, with the surrounding enclosure 30 being indicated by a broken line image. The primary components housed within enclosure 30 include (1) a switch mechanism portion 62, which is operated by the rocker switch described above (or by a lever switch or other suitable switch), (2) a convertor network portion 64, which provides a DC power supply to (3) a timer portion 66 which controls (4) a driver portion 68, which, in turn, controls the activation of (5) a switcher portion 70. As the switcher portion 70 is alternately activated and deactivated by the timer and driver portions, it permits the periodic flow of current from lead 16 to lead 18 through light bulb 14, causing light bulb 14 to flash on and off. Inasmuch as switcher portion 70 is switching 120 volt AC household current, light bulb 14 can be an ordinary 120 volt light bulb, and there is no need to provide special low-voltage lightbulbs for use with the system of the present invention.

Switch mechanism portion 62 includes selectors 72, 72,, which are movable by the rocker switch between "off" positions 73, 73', in which the selectors are physically removed from contact with lead 16 so as to interrupt the flow of current therethrough, to "flash" and "on" positions 74, 74' and 75, 75', in which selector 72 is in contact with lead 16 so as to permit the flow of current therethrough to switcher portion 70. Driver portion 68 provides a control function which periodically actuates switcher portion 70; when switcher portion 70 is actuated, current is permitted to flow through lead 16 to light bulb 14 and lead 18, causing light bulb 14 to be lit.

The duration of the period over which the driver portion 68 is activated so as to actuate switcher portion 70, is, in turn, controlled by timer portion 66, which is preferably an IC chip timer. Low voltage DC power is supplied to the timer portion 66 via connector 76 from the convertor network 64, this being connected across leads **16*b* and 16*d* by leads 78 and 79. The control current which actually initiates the switcher operation, however, is preferably supplied directly from the convertor network via lead 77**, for reasons Which will become apparent from the following description.

Figure 5:
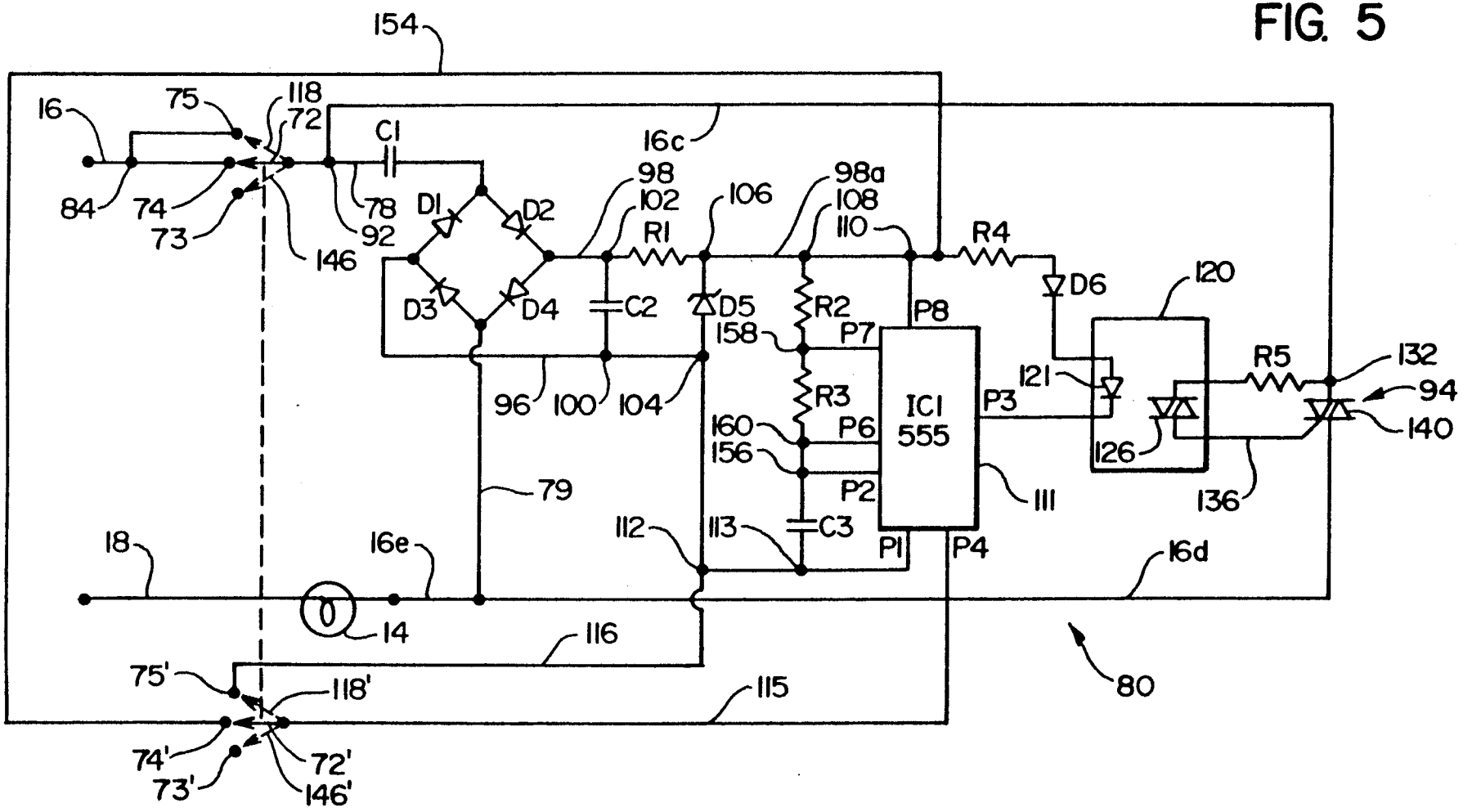
FIG. 5 shows a diagram of a first embodiment of circuit implementing the block diagram of FIG. 4.

FIG. 5 shows a first embodiment of flasher circuit used to implement the block diagram of FIG. 4. 120 volt AC power supply lead 16 is connected via junction 84 to the "flash" and "on" contacts 74, 75. When the primary selector 72 is moved to the primary "off" contact 73, secondary selector 72' is simultaneously moved to secondary "off" contact 73'; in this position, selector 72 is physically removed from contact with lead 16, and power to the whole of circuit 80 is interrupted so that light bulb 14 remains unlit. Then, when primary selector 72 is moved into contact with the primary "flash" contact 74, and secondary selector 72' moves into contact with secondary "flash" contact 74', power flows from lead 16 via selector 72, junction 92, and lead portion **16*c*, to the first side of a triac 94. As is well known to those skilled in the art, a triac is a form of relay capable of switching a high voltage, high current circuit on and off. Since the triac 140 is capable of switching 120 volt AC current, there is no need for a transformer or other bulky device to step the current down to some lower voltage, thereby keeping the overall physical size of circuit 80** small enough to fit within a housing which is mountable in a conventional light switch junction box.

The on-and-off actuation of triac 140 is controlled by the driver, timer, and convertor network portions of circuit 80. Power is supplied to the first side of the convertor network portion via lead 78, which, as is shown in FIG. 5, is connected from junction 92 to capacitor C1, via resistor R1. Resistor R1 is a relatively small resistor (e.g., 330 ohm) which eliminates voltage spikes so as to protect the diodes and other components which are "downstream" of capacitor C1 from damage, since, as will be described in greater detail below, maximum current is permitted to flow through capacitor C1 until voltage begins to build up across it. Capacitor C1 drops the 120V AC current down to some lower voltage, for example, 20 volts AC, to satisfy the requirements of the convertor portion of the circuit. It should be noted in this regard that, although using a reduced-voltage power supply greatly facilitates the use of inexpensive and physically small components in circuit 80, it may be found desirable in some applications to employ certain of these components as do not require a reduced voltage supply current.

Using a capacitor C1 in the arrangement described in the preceding paragraph provides the circuit with several advantages. First, using the capacitor to drop the voltage, instead of using a resistor to do this, minimizes or eliminates the problem of having to dissipate heat, and so helps keep the components of the circuit small enough to fit within a switch box. Also, and perhaps more significantly, use of a capacitor C1 in conjunction with a triac (or an SCR) as the main switching device in the circuit permits the actuation of the triac to be essentially "divorced" from the power supply requirements of the timer portion of the circuit, with the result that the duty cycle of the circuit can be set at any virtually desired value, and furthermore, the circuit operates with virtually no degradation of the brilliance of the porch light bulb. This aspect of the present invention will be described in greater detail below, with reference to FIGS. 7 and 8.

Capacitor C1 is connected via lead **78*a* to a diode combination D1, D2, D3, D4, at the junction between diodes D1 and D2. The diode combination, in turn, is connected by lead 79, at the junction between diodes D3 and D4, to lead portion 16*d*. The diode combination converts the 20 volt AC current which is outputted from capacitor C1 to 20 volt pulsating DC current, which is applied across positive output lead 98 and negative output lead 96. A second capacitor C2 is connected across leads 98 and 96 at junctions 100, 102, and this filters out the current outputted from the diode array, reducing it from a pulsating DC current to more of a straight line DC current. Furthermore, a zener diode D5 is connected across leads 96 and 98 at junctions 104, 106**, which limits the voltage outputted by the diode array to a predetermined maximum, for example, 15 volts DC.

From junction 106, the positive supply voltage lead 98*a* is connected via junctions 108 and 110 to the supply voltage pin P8 of a 555 integrated circuit timer 111 (IC1). Similarly, the negative lead 96*a* is connected from junction 104, through junctions 112 and 113, to the ground pin P1 of the timer.

The 555 IC timer is the central component of the timer portion of circuit 80, and, as is well known to those skilled in the art, this is an inexpensive and effective stable timing-circuit device which can be used as a timer with trigger and reset provisions. A conventional 555 IC timer which is suitable for use in the circuit of the present invention is the Archer TM TLC555 Timer, which is available from Radio Shack, a Division of Tandy Corporation, Fort Worth, Tex. 76102. The timer is capable of producing time periods ranging from microseconds to hours, depending on the value of the associated external timing components (resistors R2 and R3, and capacitor C3, as discussed below). A conventional 555 IC timer is provided with eight connection pins, which are designated as follows: P1-GROUND, P2-TRIGGER, P3-OUTPUT, P4-RESET, P5-CONTROL VOLTAGE, P6-THRESHOLD, P7-DISCHARGE, P8-SUPPLY VOLTAGE. These pins are connected to various internal components, including a transistor, a flip-flop, and first and second comparators. The timer can be used as a monostable multi-vibrator, or as an astable multi-vibrator. Typically, the supply voltage ($V_{cc}$) can range from approximately +4.5 to +18 volts. While the 555 IC timer is a particularly suitable timing device for use in the present invention, it should, of course, be recognized that other timer devices exist which could be substituted for the 555 IC timer in circuit 80, such as, for example, an operation amplifier configured for timer operation, or one-half of a 556 IC timer.

FIG. 5 shows timer 111 (IC1) connected in the circuit so as to operate in the astable mode, so that the timer will trigger itself and operate as a free-running multivibrator. The external timing components consist of first and second resistors R2 and R3, and a capacitor C3. First resistor R2 is connected between the positive supply voltage lead 98 and the discharge pin P7 of the timer, and second resistor R3 is connected between discharge pin P7 and the threshold and trigger pins P6, P2. These latter pins are connected, in turn, through capacitor C3 to the negative supply voltage lead 96 at junction 113. Capacitor C3 charges through both resistors R2 and R3, but discharges through resistor R3 alone, into discharge pin P7. As a result, the duty cycle (ratio of on-to-off time) is controlled by the ratio of resistors R2 and R3, the timing and frequency equations for the 555 IC timer being as follows:

Charge Time $T_1 = 0.693\ (R2 + R3)\ C3$

-continued (Output "High")
Discharge Time $T_2 = 0.693\ (R3)\ C3$
(Output "Low")
Total Cycle Time $T = T_1 + T_2 = 0.693\ (R2 + 2R3)\ C3$
Frequency for
Oscillation $f = 1/T = 1.44/((R2 + 2R3)\ C3)$
Duty Cycle $D = R3/(R2 + 2R3)$ The threshold and trigger levels of the timer are normally two-thirds and one-third, respectively, of $V_{cc}$. When the trigger input (pin P2) falls below the trigger level ($\frac{1}{3}\ V_{cc}$), the internal flip-flop of the timer is set, and the output (pin P3) goes to a "high" condition. Then, when the trigger input (pin P2) is above the trigger level ($\frac{1}{3}\ V_{cc}$), and the threshold input (pin P6) is above the threshold level ($\frac{2}{3}\ V_{cc}$), the flip-flop is reset and the output (pin P3) goes back to its "low" condition. Also, when the reset input (pin P4) goes low, the flip-flop is reset and the output (pin P3) again goes to the "low" condition. When the output (pin P3) is in the "low" condition, a low impedance path is provided between pin P3 and the ground pin P1. These relationships are summarized in the following Function Table:

TABLE 1

| Pin P4 (RESET) | Pin P2 (TRIGGER VOLTAGE) | Pin P6 (THRESHOLD VOLTAGE) | Pin P3 (OUTPUT) | Pin P7 (DISCHARGE SWITCH |
|---|---|---|---|---|
| Low | Irrelevant | Irrelevant | Low | On |
| High | $<\frac{1}{3}\ V_{cc}$ | Irrelevant | High | Off |
| High | $>\frac{1}{3}\ V_{cc}$ | $>\frac{2}{3}\ V_{cc}$ | Low | On |
| High | $>\frac{1}{3}\ V_{cc}$ | $<\frac{2}{3}\ V_{cc}$ | As previously est. | |

So, looking circuit 80 again, when selectors 72, 72' are in either the "on" position or the "flash" position, the positive output of the diode array is connected to pin P8, so as to provide the supply voltage which activates the timer. If the "on" position has been selected (as indicated by broken line images 118, 118'), the reset pin P4 is connected to ground pin P1, which consequently holds reset pin P4 continuously in the "low" condition; as is shown in Table 1, when reset pin P4 is held in the "low" condition, output pin 3 is also held in a "low" condition. Thus, current is able to flow from junction 102 on lead 98, through the optoisolator 120 of triac driver portion 68, and into pin P3 of the timer. Resistor R4 serves to limit this current so as to satisfy the power limitations of the LED 121 in the optoisolator. The current flowing through optoisolator 120 and into pin P3 causes LED 121 to activate, and the light which it emits is transmitted in the direction indicated by the arrow to the internal, light-actuated triac 126. This actuates internal triac 126 so that it permits current to flow through it.

Light-activated internal triac 126 is connected, in turn, to "hot" lead 16*c* at junction 132, with a resistor R5 being connected between the junction and the optoisolator to limit the current to meet the requirements of the internal triac. The output side of the internal triac is then connected by lead 136 to primary triac 140, so that the current outputted from the internal triac of the optoisolator serves as a gate current which actuates the primary triac, causing the latter to substantially continuously permit the flow of current therethrough, so that this closes the circuit and energizes the porch light. Once the main triac is activated, the primary current continues to flow through it until (a) the gate current (flowing through lead 136) drops below a certain minimum level, and (b) the primary current (flowing from lead 16c to 16d in FIG. 5) also drops below a certain minimum level. As will be described in greater detail below, these conditions occur every half cycle, when the current and voltage through leads 16c, 16d drop to zero; when this happens, the main triac "opens", interrupting the circuit, but it is immediately reactivated again at the commencement of the next half cycle, so that light bulb 14 remains substantially continuously lit.

An example of a triac suitable for use as the primary triac 140 in the circuit of the present invention is the Archer TM 276-1000 (400 volt, 6 amp) triac, available from Radio Shack, a Division of Tandy Corporation. The triac is capable of switching the full 120V AC current, and, unlike some power switches which are configured essentially as diodes, it allows the full AC cycle to pass through it in other words, relatively simpler diode-type switches permit the AC current to pass through only in one direction, so that, in essence, the current is "off" for half of the cycle, with result that the intensity of the flashing porch light is greatly reduced. While triacs are thus preferable to many known switching devices, and are also inexpensive and long-lasting, there are, of course, a number of other relay devices known to those skilled in the art which could be employed in the circuit in place of a triac.

An example of a suitable optoisolator for use in the flasher circuit of FIG. 5 is an Archer TM MOC 3010 optoisolator, available from Radio Shack, a Division of Tandy Corporation.

With reference again to FIG. 5, if the "flash" mode is selected, the selectors are moved to the central "flash" positions indicated by solid line images 72, 72'. In this configuration, the reset pin P4 of the IC timer is connected to the positive output of the diode array D1, D2, D3, D4. Since the output current thus is able to flow from the diode array to the reset pin, this places reset pin P4 in the "high" condition; the timer is thus activated and placed in condition for astable operation, becoming, in essence, an oscillator timer. In its initial condition, pin P2 is in a "low" state (e.g., at less than $\frac{1}{3}$ $V_{cc}$—see Table 1 above), while output pin P3 is in the "high" state. Current consequently flows from junction 108, through resistors R2 and R3, to junction 156 at pin P2. The other side junction 156 is connected by lead 162 to a first side of capacitor C3, the other side of which is connected via lead 164 to the negative output of the diode array at junction 112.

During the initial phase of operation, the voltage builds up at junction 156 on the first side of capacitor C3. Once this voltage exceeds $\frac{2}{3}$ $V_{cc}$, so that both (a) the voltage at pin P2 exceeds $\frac{1}{3}$ $V_{cc}$, and (b) the voltage at pin P6 exceeds $\frac{2}{3}$ $V_{cc}$, the output pin P3 shifts to its "low" condition (see Table 1). Simultaneously, as an internal function of the timer, discharge pin P7 also goes to a "low" condition, placing the junction 158 between resistors R2 and R3 in a "low" condition. Capacitor C3, which was charged up to a relatively high voltage ($>\frac{2}{3}$ $V_{cc}$) during the preceding phase, then discharges back through resistor R3 and junction 158 into discharge pin P7. As this is done, the voltage at junction 156 (pin P2) drops off, and when it drops below $\frac{1}{3}$ $V_{cc}$, the output pin P3 returns to its "high" condition, as indicated in Table 1. As previously described the time of the cycle from high to low voltage is set by the values of capacitor C3 and resistors R2 and R3. In setting up the circuit shown in FIG. 5, it has been found preferable to employ relatively high resistance (R2, R3), as opposed to high capacitance (C3), in order to keep the physical size of the capacitor relatively small.

During the just-described sequence, output pin P3 cycled from a "high" condition to a "low" condition, and then back to its "high" condition. When pin P3 is in its "high" condition, current is prevented from flowing through optoisolator 120, so that LED 121 remains unlit. This, in turn, leaves the primary triac 140 in its deactivated state, so that it prevents flow of current therethrough. When pin P3 subsequently shifts to its "low" condition, it enables the output of the diode array to flow through optoisolator 120 and into pin P3, causing LED 121 to light and actuate the primary triac 140, in turn causing light bulb 14 to be illuminated. Then, when pin P3 returns to its "high" condition, light bulb 14 is extinguished. Hence, as output pin P3 of the 555 IC timer periodically cycles between the "low" and "high" states, the light bulb 14 of porch light fixture 12 flashes on and off; the rate at which the light flashes may be selected to effectively draw people's attention, and may be, for example, on the order of 1–4 times per second.

A neon light bulb 166 is also connected across leads 16c and 16d, at junctions 168 and 170, and a resistor R5 is connected in series with this in order to limit the flow of current therethrough to the requirements of the bulb. This neon light bulb flashes on-and-off in a cycle opposite that of the porch light bulb: when output pin P3 is in the "low" condition (so that light bulb 14 is illuminated), current flows through the main triac 140 instead of flowing through the neon light bulb and its associated resistor, but when pin P3 is in the high condition, triac 140 opens, with the result that the current flows through neon light bulb 250 and energizes it. Neon light bulb 250 is positioned within housing 30 so that it shines through the translucent central panel 58 of rocker switch 40 (see FIG. 3), illuminating the "HELP" legend on panel 58 and providing the operator with a visual signal that the system is operating in the emergency mode. If a conventional toggle-type switch is substituted for the rocker-type switch which is shown in FIGS. 2 and 3, the neon light may be positioned within a translucent lever portion of the toggle-type switch.

Furthermore, as was briefly noted above, it will also be highly desirable for many embodiments of the present invention to incorporate a "beeper" or other device for producing an audible signal which can be heard by the occupants of the house when the flash mode has been selected. Not only does this help assure the occupant that a signal is being sent to help emergency response personnel locate the dwelling, but it also eliminates the possibility that the switch may be accidentally left in the flash mode. Furthermore, in some embodiments, it may be desirable to provide an audible signal which is sufficiently loud and irritating in tone to discourage its unauthorized use, so as to help prevent children from playing with it and leaving the flash mode selected, or to prevent the occupants of the house from using it for undesirable purposes which might confuse or falsely alarm police or other emergency response personnel, such as, for example, signaling the location of a party or catching the attention of a delivery driver.

Figure 6:
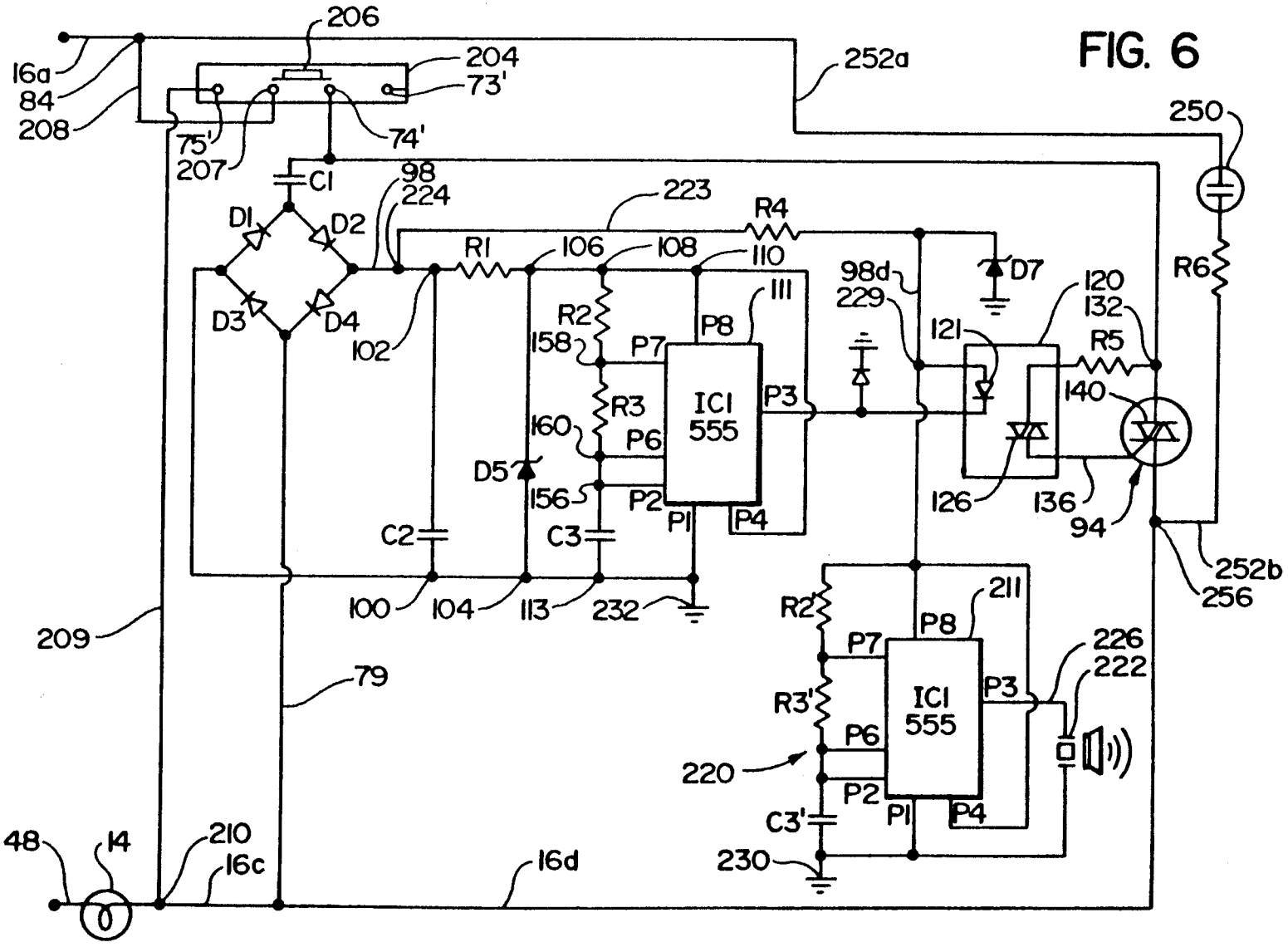
FIG. 6 shows a circuit diagram for an another embodiment of circuit in accordance with the present invention, this incorporating a "beeper" for emitting an audible signal to indicate that the flash mode has been activated.

FIG. 6 illustrates an embodiment of the present invention which incorporates such a "beeper" or other sound emiting device. The circuit shown in FIG. 6 is similar in its overall configuration to that shown in FIG. 5, with the exception that (1) a secondary circuit and timer have been added for operating the "beeper", and (2) the neon light has been connected to the incoming lead 16*a*. Accordingly. Like reference numerals refer to like elements in both FIGS. 5 and 6. A central aspect of the circuit shown in FIG. 6 is that it is provided with first and second 555 IC timers, 111 (IC1) and 211 (IC2) ; the first of these (111/IC1) serves primarily to control optoisolator 120 in the manner previously described, so that porch light bulb 14 flashes on and off at the desired periodicity. The second 555 IC timer (211/IC2), forms a part of subcircuit 220, and this serves to operate a piezoelectric element 222 so that the element emits a beeping sound at a desired frequency.

As previously described, the operation of the circuit is controlled by a selector switch. In the particular selector switch 204 which is shown in FIG. 6, there is a sliding contact 206 which bridges the gaps between the contacts in the switch. In the "off" position, sliding contact 206 bridges the gap between the "flash" contact 74 (which is connected to the main triac 140 and the associated convertor network, timer, and triac driver portions of the circuit) and a contact 73, which is simply an open. In the "flash" position, sliding contact 206 bridges the gap between a "hot" contact 207 (which is connected by lead 208 to high voltage lead 16 at junction 84) and the "flash" contact 74, so that the circuit flashes porch light bulb 14 on-and-off in the manner previously described. In the "on" position, sliding contact 206 bridges the gap between "hot" contact 207 and "on" contact 75, which is connected directly via lead 20*g* to junction 210 on lead 16*e;* thus voltage is supplied directly from lead 16*a* to lead 16*e* so that porch light bulb 14 remains continuously lit, and the main triac 140 (along with the associated convertor network, timer, and triac driver portions of the circuit) are consequently bypassed when this switch position is selected.

Power is supplied to the "beeper" subcircuit 220 by a lead 223, which is connected at junction 224 to the positive output lead 98 from the diode array D1, D2, D3, D4. A resistor R4 is connected in lead 223, this having a relatively low resistance and serving to prevent large transients from damaging components in subcircuit 220. The secondary 555 IC timer 211 (IC2) is configured as an oscillator as previously described. In this case, when the output of pin 3 of timer 211 cycles to "high", this output passes through lead 226 to piezoelectric element 222, which is connected to ground on its other side by a lead 228, causing the element to be activated so that it emits an audible signal. Since the output of pin 3 cycles between "high" and "low" states as previously described, the acoustic output of piezoelectric element 222 buzzes or pulsates accordingly; the use of a secondary timer in the circuit shown in FIG. 6 permits the secondary oscillator to be configured to operate the beeper on a cycle which is completely independent from that of the primary timer 111 by selecting resistors R2' and R3' and capacitor C3' as desired. For example, it has been found suitable to configure the subcircuit 220 so that the secondary timer 211 cycles the activation of the "beeper" somewhere in the range of about 100–20,000 Hz (the normally audible range), with 2,000 Hz having been found to provide a particularly effective sound for bringing the operation of the device to the attention of an occupant of the building.

Lead 223, as well as supplying power to subcircuit 220, is also connected (at junction 229) to one of the two leads of the internal LED 121 of optoisolator 120, the other lead of the LED being connected to pin 3 of the primary 555 IC timer 111 (IC1). Consequently, it will be understood that when the optoisolator 120 is activated by the primary timer 111 (so that triac 140 is closed and porch light bulb 14 is lit), the current is flowing from lead 223 into pin P3 of the primary timer (which is in the "low" condition) instead of to the secondary timer, so that piezoelectric element 222 remains silent during this period; then, when pin P3 of the primary timer shifts to the "high" condition, so that the optoisolator and primary triac are deactivated, the current flows from lead 223 to voltage supply pin P8 of the secondary timer (as well as to the remaining components of subcircuit 220) so that the piezoelectric element is activated. In other words, when the porch light periodically flashes on, the "beeper" will be de-activated, and then when the porch light flashes off, the beeper will be activated so that it oscillates at its predetermined frequency.

In the particular embodiment illustrated in FIG. 6, the negative side of capacitor C3 and pin P1 of the primary timer 111 are connected to ground 232. Similarly, capacitor C3' of subcircuit 220 and pin pl of the secondary 555 timer 211 are also connected to ground at 230. This is a simple and effective arrangement for completing each of these subcircuits; however, it will be understood by those skilled in the art that the negative sides of these components can be connected in a complete circuit without necessarily being connected directly to ground.

FIG. 6 also shows a neon light bulb 250, which is connected by lead 252*a* to 120V AC lead 16 on the "hot" side of switch 204 (at junction 84), and then by lead 252*b* to junction 256 in lead 16*d* between triac 140 and porch light bulb 14. A resistor R6 is also connected in lead 252, in series with bulb 250. Neon light 250 has essentially the same primary function as that shown in FIG. 5, in that it flashes to provide a visual indication that the emergency "flash" mode has been selected. Additionally, in this embodiment the neon light remains continuously lit when the main "off" mode has been selected, thus helping the operator to locate the switch toggle in a darkened room, since when the switch is in the "off" position, current will flow via leads 252*a* and 252*b* through resistor R6 and light bulb 250 so that the bulb remains continuously lit. Then, when the "flash" mode is selected, the neon light bulb flashes on-and-off; when the primary triac 140 is deactivated so as to prevent the flow of current therethrough which would illuminate the porch light bulb 14, the current flows instead through bulb 250 and resistor R6 so that the neon light bulb is lit, and when the primary triac is activated so that current flows therethrough so as to light the porch light, resistor R6 prevents the flow of current through bulb 250 so that it remains dark during this part of the cycle. Accordingly, neon light bulb 250 flashes on and off in a cycle opposite porch light bulb 14.

As for the piezoelectric elements employed in the circuits of FIG. 6, this can be any suitable electrical element which emits an audible signal in response to a voltage being applied across it.

Having described the operation of the circuits shown in FIGS. 5 and 6, several of the significant advantages which are achieved by using capacitor (C1) to step down the voltage for the control portions of the circuit, in conjunction with using a triac (140) for switching the main current on and off, will now be discussed in greater detail. One of the most significant of these advantages stems from the fact that the main triac needs only an initial "pulse" of gate current in order to be activated, and it will then remain closed so long as there is current applied across it: thus, there is no need to supply gate current continuously in order to keep current flowing through the main triac once it has been actuated. The circuits shown in FIGS. 5 and 6 take advantage of this fact by using the current lead characteristics which are inherent in capacitor C1 to obtain a short, low-voltage "pulse" of gait current which activates the main triac with a minimum expenditure of energy.

Figure 7A:
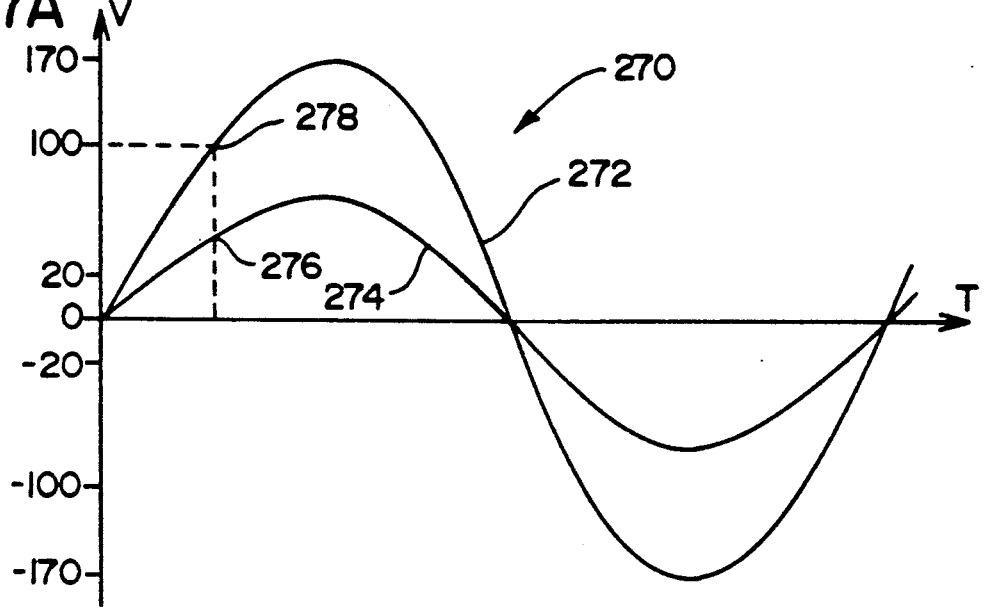
FIGS. 7A–B show first and second 120V 60 Hz AC sine waves representing the cycle of a standard house current, FIG. 7A showing the unmodified current and FIG. 7B illustrating the current lead affect of a capacitor incorporated in the switch, and how this permits a low voltage supply current pulse to pass therethrough.
Figure 7B:
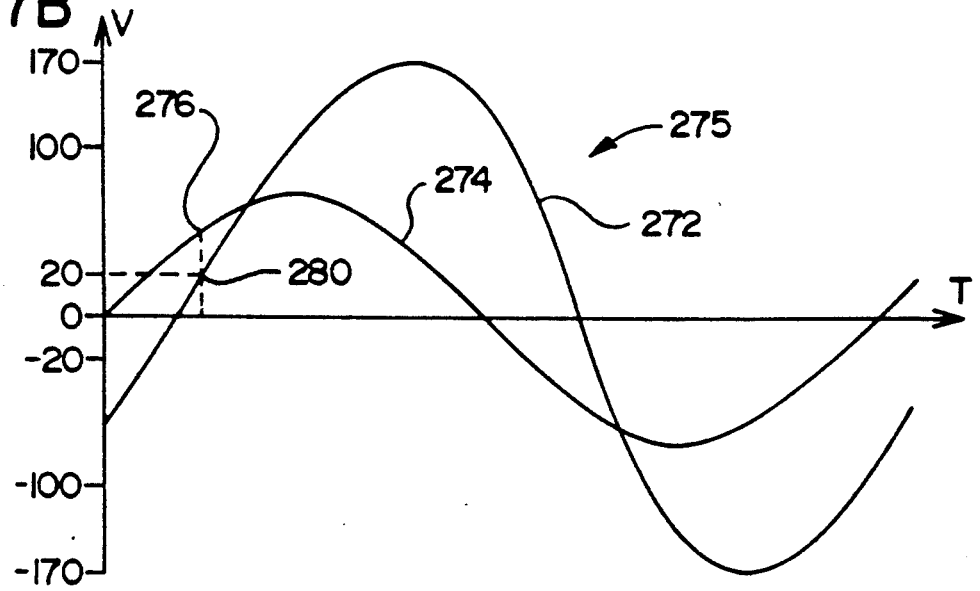

FIGS. 7A and 7B demonstrate the voltage lead characteristics of an exemplary capacitor C1, as this relates to the circuits shown in FIGS. 5 and 6. FIG. 7A shows a sine wave 270 representing the cycle of a standard, unmodified 120V AC household current, with curve 272 representing voltage and curve 274 representing current. As is shown, the voltage and current curves are initially more-or-less in phase, so that their peaks and minimums coincide. "120V" AC current is, of course, actually 120 volts RMS, so the peak voltage is actually ±170 volts, as is shown in FIGS. 7A and 7B. Furthermore, it should be noted here that, although 120V 60 Hz AC current is the standard in the United States, there are, of course, a number of other standard household currents in use throughtout the world (e.g., 200V 50 Hz AC), and it is well within the ability of those skilled in the art to modify the exemplary circuits shown herein to properly function with these.

As previously described the power for the control portions of the circuits is taken from the 120V AC current, and let us assume, for exemplary purposes, that the current requirement for actuating the internal LED of the optoisolator 120 is 10 milliamps (this is typical of such optoisolators, which generally have relatively low current requirements). 10 milliamps is represented on exemplary current curve 274 by point 276, and this corresponds in time to a specific voltage on curve 222; in this case the corresponding voltage is 100 volts, as indicated at point 278. Thus, in order to obtain the 10 milliamps required to operate the optoisolator, it will be necessary to use up 100 volts of the unmodified current half-cycle, and so a relatively great portion of the available energy would be so expended.

FIG. 7B, by contrast, illustrates the situation when the 120V AC current has passed through an exemplary capacitor C1 (disregarding for purposes of illustration any voltage step-down which would also occur). The resulting current lead effect is shown in FIG. 7B by the fact that the current and voltage curves are now essentially out of phase; this is because the capacitor initially allows maximum current to flow through it, with the current flow subsequently dropping off as the voltage builds across the capacitor. Thus, FIG. 7B shows the current curve 274 increasing before the voltage curve 272, and then dropping off as the voltage curve builds towards its peak. The net affect of this is that the 10 milliamp point 276 on current curve 274 now corresponds in time to a much lower point on the voltage curve; in the example shown in FIG. 7B, the 10 milliamp point 276 now corresponds to a 20V point 280 on voltage curve 272, instead of the 100V point shown in FIG. 7A. This lower voltage is sufficient to energize the internal LED of the optoisolator, being that the current need only flow into pin P3 of the timer, which is in its "low" condition. Thus, use of the capacitor C1 permits 10 milliamps of current to be supplied to the optoisolator at a much lower voltage, and with much reduced expenditure of the available energy.

Figure 8A:
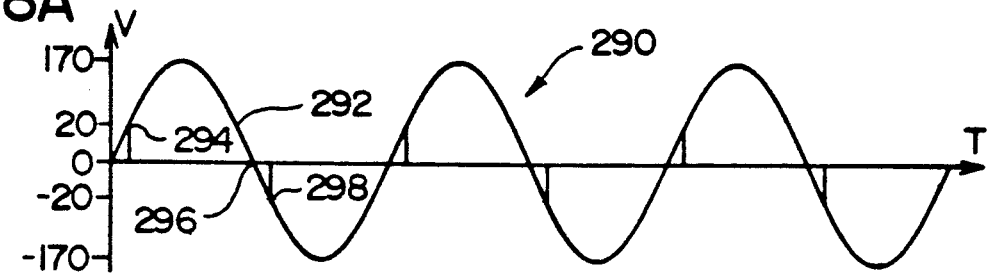
FIGS. 8A–C show a sine wave similar to that shown in FIGS. 7A–C and illustrate the portions of the current cycle which are employed to (a) provide the pulse for turning on the main current flow to the main light bulb, and (b) illuminate the bulb itself.
Figure 8B:
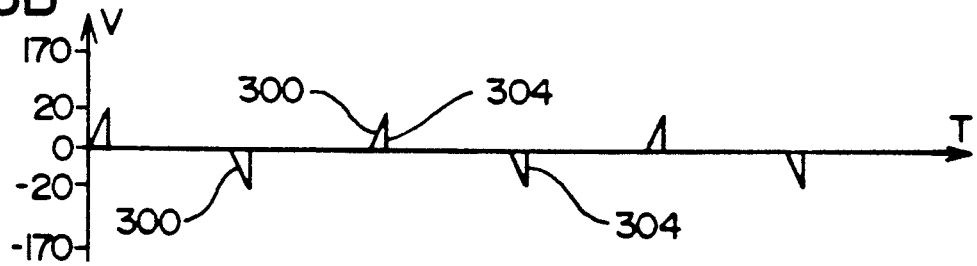
Figure 8C:
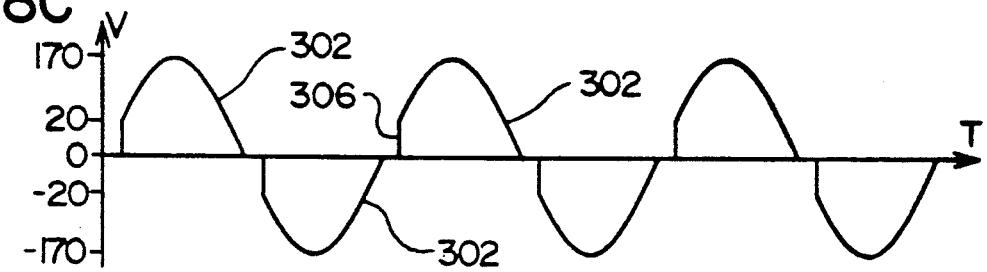
Figure 9:
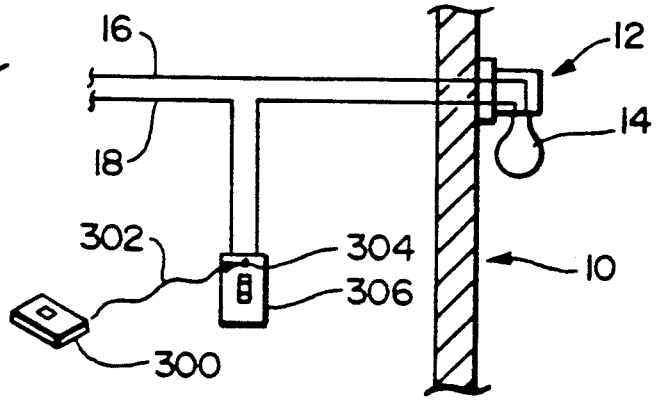
FIG. 9 is a schematic view, similar to that of FIG. 1, showing an embodiment of the invention in which the switch unit is activated by remote control.

FIGS. 8A–8C show the allocation of power to the switch mechanism, as compared to that supplied to the main light bulb, using the exemplary values derived from FIGS. 7A and 7B.

FIG. 8A shows a sine wave 290 representing the voltage curve 292 of the standard 120V AC household current. As previously described, this current is supplied to both (a) the main triac (140), and (b) the internal convertor network, timer, and triac driver which control the operation of the main triac, both of these being connected to the "hot" lead 16 at junction 92. Since capacitor C1 is used to step down the voltage supplied to the convertor network, maximum current initially flows through the capacitor to the diode array and optoisolator 120, energizing internal LED 121. As previously described, the current required to do this is assumed to be 10 milliamps, and, because of the current lead affect of capacitor C1, this corresponds to 20 volts on the voltage curve, as indicated by point 294. Thus, once this point in the cycle is reached, the internal triac 126 is activated, so that this, in turn, permits the gate current to flow through lead 136 to energize the main triac 140. However, once the main triac is actuated, the current flows through it from junction 92, in essence "grounding out" the convertor network, timer, and triac driver portions of the circuit, so that the remaining portion of the AC half cycle is directed entirely through light bulb 14; current thus ceases to flow through the control portions of the circuit, and, likewise, the gate current ceases to flow to the main triac 140, but, as noted above, the main triac remains activated so long as current is applied across its main leads.

However, when the current cycle subsequently reaches the halfway point (i.e., the end of the half-cycle, at 1/120 th of a second from the beginning of the cycle) the voltage drops to zero as indicated at point 296. When this happens, the main triac 140 de-energizes or "opens" again (as previously described), so that another gate current pulse is required to reactivate it. This occurs at the beginning at the next half cycle, and in this case the necessary 10 milliamps of current is supplied to the optoisolator at the −20V point in the cycle, as indicated by point 298. This activates the main triac again, grounding out the control portions of the circuit and directing the full energy of current to the main light bulb 14 for the remainder of the half cycle. The voltage then passes through zero again, after which the previously described sequence repeats itself.

From the foregoing, it is apparent that the circuits shown in FIGS. 5 and 6 are, in essence, "stealing" a small pulse of energy at the beginning of each half cycle of the AC supply current, and using this pulse to switch on the main triac; these small pulses are also being supplied to capacitor C2, and this is sufficient to keep capacitor C2 charged up so that it can supply the necessary energy to keep the 555 IC timer 111 operating in the manner previously described.

FIG. 8B illustrates these small pulses of energy 300 which are captured by the control portions of the circuit. Because these small pulses of energy are received at the beginning of each half-cycle, the control portions of the circuit do not have to rely on a "shut down" period of the main light bulb to charge up capacitor C2 so that it can operate the timer and triac driver portions of the circuit; the net effect of this is that the circuit can be set to provide whatever duty cycle is desired for the main light bulb 14, since the circuit is not limited to having to shut the bulb off at any given point in order to charge up the energy storage portion of the circuit. This is to be contrasted with the situation where the energy is gathered and stored only when the main circuit is open and the light bulb off; once the stored-up energy has been expended enabling the gate current and powering the timer, this sort of circuit (unlike that of the present invention) has to shut off the main light bulb until its storage capacitor can be charged up again. As previously mentioned, the practical consequence of this is that such a design can operate only on a limited duty cycle (for example, a 10–20% duty cycle) which permits only a very brief flash; the other 80–90% of the time the light bulb has to be shut off while the circuit is storing up energy.

Another advantage of the circuit of the present invention is that, as described above, the actual amount of energy used by the control portion of the circuit is relatively small, this being "stolen" at the very beginning of each half cycle. Most of the energy, of course, is towards the peak of the half cycle, as is apparent from the partial curves 302 shown in FIG. 8C; these represent the remaining energy of each half-cycle which is supplied directly to the main light bulb 14 (through the triac 140), after the initial pulse of current has been captured by the control portions of the circuit. Since the vast majority of the energy thus continues to be supplied directly to the main light bulb, the bulb achieves virtually its full normal brilliance even when it is being flashed. As is also apparent from FIG. 8C, the main light bulb will be momentarily cut off at the beginning of each half cycle, but the duration of this interruption is so short that it is imperceptible.

Another significant advantage which is made possible by this arrangement (i.e., using the relatively small pulses of energy to energize the control portions of the circuit) is that this avoids the relatively great voltage transients which would otherwise occur when switching the energy to and from the control portions of the circuit. As indicated by the vertical slopes 304, 306 in FIGS. 8B and 8C, these transitions are, in this example, only 20 volts in magnitude (i.e., from 20 volts to 0, or vice versa), as opposed to, say, the 100V transient which would occur if the circuit was not configured to take advantage of the current lead effect offered by the capacitor C1. The practical effect of minimizing these transients is that it reduces the electromagnetic influence (EMI) prob)ems which would otherwise occur, such as difficulties with radio reception and the like.

It should be noted at this point that, although using a capacitor C1 as shown in FIGS. 5 and 6 to step down the voltage of the supply current provides these circuits which the advantages discussed above, it may be found desirable to substitute a resistor of similar impedance for the capacitor C1 in some circuits incorporating the present invention, primarily from the standpoint of simplicity and economy. This arrangement will still permit the control portion of the circuit to capture a pulse of energy at the beginning of each half-cycle of the supply current when operating in the "flash" mode, so that this can be used to close the main triac, after which the triac will "ground out" the control portion of the circuit so that the remainder of the half-cycle will be routed through main light bulb in the manner previously described. Likewise, the storage capacitor will still be able to store a part of each of these captured pulses so that the duty cycle of the flashing light can be set to whatever value is desired; the overheating and size problems previously discussed with respect to resistors serving in this role will be minimized or eliminated by the fact that, in the circuits incorporating the present invention, the current would flow through the resistor only in short pulses at the beginning of each half cycle, rather than continuously. However, it should also be noted that, because no current lead effect would be provided by the use of such a resistor, the current required to actuate the triac driver (i.e., the optoisolator) would be reached at some relatively higher voltage (e.g., 80–100 volts) than when using the capacitor C1, and so the voltage transients and the resulting EMI interference would be somewhat greater. Furthermore, because a significantly greater portion of the energy of each half cycle of the supply current would thus be taken by the control portions of the circuit, less energy would be left for the main bulb, and so its flashes would be somewhat dimmer than its ordinary full brilliance.

The invention may be embodied in other specific forms without departing from the spirit or essential characteristics thereof. For example, being that the circuit incorporating the present invention makes it possible to flash the light fixture at virtually any desired duty cycle and for any duration, this may be used for many applications in addition to providing an emergency signal, such as for turning interior lights on-and-off for much longer periods to deter burglars. The present embodiments are therefore to be considered in all respects as illustrative and not restrictive, the scope of the invention being indicated by the appended claims rather than by the foregoing description.

What is claimed and desired to be secured by Letters Patent of the United States is:

1. A switching device for flashing a light fixture of a dwelling, said light fixture being connected by existing first and second leads to a source of a relatively high-voltage AC current, said switching device comprising:

a switch housing mountable in a light switch junction box within the interior of said dwelling;

a switch mounted to said housing, said switch having a "flash" position, an "on" position, and an "off" position;

means responsive to selection of said "flash" position of said switch for periodically connecting said first lead to said light fixture so that said fixture flashes on and off, said means for periodically connecting said lead to said fixture comprising:

a main relay mounted in said housing and connected in said first lead for selectively permitting said high-voltage AC current to flow through said first lead to said light fixture in response to actuation of said relay by a gate current pulse, said relay being configured to remain actuated after termination of said gate current pulse so long as a predetermined minimum current is flowing through said first lead;

means for providing a said gate current pulse to said relay at the beginning of each half cycle of said high-voltage AC current, said means for providing said pulse being connected in said first lead in parallel with said main relay so as to be ground out by actuation of said main relay, so that said pulse is terminated by actuation of said main relay and the remainder of said half cycle of said high-voltage AC current flows through said relay to said light fixture, and so that said main relay remains actuated until said high-voltage AC current drops below said predetermined minimum current at the end of said half cycle; and timer means for cyclically enabling said gate current pulse to flow to said main relay at the beginning of each half-cycle of said high-voltage AC current for a first predetermined period of time, and then preventing said gate current pulse from flowing to said relay for a second predetermined period of time, so that said main relay is cyclically actuated for said first period of time and de-activated for said second period of time;

means responsive to selection of said "on" position of said switch for connecting said first lead to said exterior light fixture so that said fixture remains continuously lit to illuminate an exterior portion of said dwelling; and means responsive to selection of said "off" position of said switch for disconnecting said first lead from said exterior light fixture so that said fixture remains continuously unlit.

2. The switching device of claim 1, wherein said means for providing a said gate current pulse to said main relay at the beginning of each half cycle of said high-voltage AC current comprises a relay driver for initiating a said gate current pulse in response to receiving a pulse of a predetermined relatively low-voltage control current.

3. The switching device of claim 2, further comprising voltage-reduction means selectively connectable to said first lead in parallel with said main relay for reducing said high-voltage AC current to said relatively low-voltage control current which is received by said relay driver.

4. The switching device of claim 3, wherein said voltage-reduction means is a capacitor having a current lead effect which permits said predetermined low-voltage control current to flow through said capacitor to said relay driver at said beginning of each said half cycle prior to the voltage of said high-voltage AC current exceeding a predetermined maximum voltage, said predetermined maximum voltage being significantly less than a voltage which would be required to obtain said predetermined low voltage control current from said high-voltage AC current in the absence of said current lead effect.

5. The switching device of claim 4, further comprising a relatively low resistance resistor connected in series with said capacitor for eliminating voltage spikes which might pass through said capacitor.

6. The switching device of claim 3, wherein said voltage-reduction means is a resistor.

7. The switching device of claim 4, wherein said timing means comprises a 555 IC timer configured to operate in an astable mode.

8. The switching device of claim 7, further comprising a convertor network for converting said current flowing through said capacitor from low-voltage AC current to low-voltage DC current.

9. The switching device of claim 8, wherein said convertor network is a diode array.

10. The switching device of claim 9, further comprising a second capacitor, said second capacitor being connected across first and second output leads of said diode array for storing a portion of the energy of each said pulse of low-voltage current which flows through said first capacitor, said second capacitor further being connected across the supply voltage and ground pins of said 555 IC timer for supplying said stored energy to said 555 IC timer so as to operate said timer.

11. The switching device of claim 7, wherein said main relay is a primary triac.

12. The switching device of claim 11, wherein said relay driver comprises an optoisolator having an internal LED which is actuated by each said control current pulse which flows to said optoisolator at the beginning of a said half-cycle of said high-voltage AC current, and an internal triac which is actuated in response to actuation of said LED, said internal triac being connected to said primary triac so as to provide a said gate current pulse thereto in response to each actuation of said internal triac.

13. The switching device of claim 12, wherein a first lead of said internal LED is connected to said capacitor, and a second lead of said LED is connected to the output pin of said 555 IC timer so that when said output pin of said timer cyclically shifts to its low state, said control current pulses flow to said optoisolator and actuate said internal LED, and when said output pin cyclically shifts to its high state, said control current pulses cease to flow to said optoisolator.

14. The switching device of claim 1, further comprising means responsive to selection of said "flash" position of said switch for generating an audible signal which indicates to an operator that the light fixture is being flashed on-and-off.

15. The switching device of claim 3, further comprising:

a piezoelectric element connected to said voltage-reduction means so that said relatively low-voltage control current flows from said voltage-reduction to said piezoelectric element and a second timer means for cyclically permitting flow of said control current through said piezoelectric element is cyclically actuated to emit an audible signal which indicates to an operator that said light fixture is being flashed on-and-off.

16. The switching device of claim 15, wherein said first and second timer means are each IC timers configured to operate in an astable mode.

17. The switching device of claim 15, wherein said first and second timer means are each one-half of a single 556 IC timer, each said one-half of said 556 IC timer being configured to operate independently of the other in an astable mode.

18. A switching device for flashing an exterior light fixture of a dwelling, said light fixture being connected by first and second existing leads to a source of high-voltage alternating current, said switching device comprising:

a switch housing mountable within the interior of said dwelling;

a switch mounted to said switch housing and having an "off" position, an "on" position, and a "flash" position;

means responsive to selection of said "off" position for interrupting said circuit so as to prevent flow of current through at least one said lead so that said light fixture remains continuously unlit;

means responsive to selection of said "on" position for completing said circuit so as to permit continuous flow of current through said leads so that said light fixture remains continuously lit to illuminate an exterior portion of said dwelling;

automatic means responsive to selection of said "flash" position for cyclically completing sand interrupting said circuit so as to permit periodic flow of current through said leads so that said light fixture flashes and-and-off to draw the attention of emergency response personnel to said dwelling, said means for cyclically completing and interrupting said circuit comprising:

a main relay connected in said first lead for selectively permitting said high-voltage AC current to flow through said first lead to said light fixture in response to actuation of said relay by a gate current pulse; and means for cyclically supplying a said gate current pulse to said relay for a first predetermined period of time and then removing said gate current pulse from said relay for a second predetermined period of time, so that said relay is cyclically actuated for said first period of time and then de-actuated for said second period of time; and means also response to selection of said "flash" position for generating an audible signal indicating to an occupant of said dwelling that said light fixture is flashing on-and-off to draw said attention of said emergency response personnel.

19. A switching device for flashing a light fixture of a dwelling, said light fixture being connected by first and second leads to a source of a relatively high-voltage AC current, said switching device comprising:

a switch having a "flash" position; and means responsive to selection of said "flash" position for periodically connecting said first lead to said light fixture so that said fixture flashes on and off, said means comprising:

a main relay connected in said first lead for selectively permitting said high-voltage AC current to flow through said first lead to said light fixture in response to actuation of said relay by a gate current pulse, said relay being configured to remain actuated after termination of said gate current pulse so long as a predetermined minimum current is flowing through said first lead;

means for providing a said gate current pulse to said relay at the beginning of each half cycle of said high-voltage AC current, said means for providing said pulse being connected in said first lead in parallel with said main relay so as to be grounded out by actuation of said main relay, so that said pulse is terminated by actuation of said main relay and the remainder of said half cycle of said high-voltage AC current flows through said relay to said light fixture, and so that said main relay remains actuated until said high-voltage AC current drops below said predetermined minimum current at the end of said half cycle; and control means for enabling said gate current pulse to flow to said main relay at the beginning of each half-cycle of said high-voltage AC current for a first predetermined period of time, and then preventing said gate current pulse from flowing to said relay for a second predetermined period of time, so that said main relay is actuated for said first period of time and deactivated for said second period of time.

20. The switching device of claim 19, wherein said means for providing a said gate current pulse to said main relay at the beginning of each half cycle of said AC current comprises a relay driver for initiating a said gate current pulse in response to receiving a pulse of a predetermined relatively low-voltage control current.

21. The switching device of claim 20, further comprising voltage-reduction means selectively connectable to said first lead in parallel with said main relay for reducing said high-voltage AC current to said relatively low-voltage control current which is received by said relay driver.

22. The switching device of claim 21, wherein said voltage-reduction means is a capacitor having a current lead effect which permits said predetermined low-voltage control current to flow through said capacitor to said relay driver at said beginning of each said half cycle prior to the voltage of said high-voltage AC current exceeding a predetermined maximum voltage, said predetermined maximum voltage being significantly less than a voltage which would be required to obtain said predetermined low voltage control current from said high-voltage AC current in the absence of said current lead effect.

23. The switching device of claim 22, further comprising:

means for storing a portion of the energy of each said pulse of low voltage current and supplying said stored energy to said control means so as to operate said control means.

24. The switching device of claim 23, wherein said control means for enabling said gate current pulse to flow for a predetermined period of time comprises a 555 IC timer configured to operate in an astable mode.

25. The switching device of claim 24, further comprising a convertor network for converting said low-voltage control current flowing through said capacitor from low-voltage AC current to low-voltage DC current.

26. The switching device of claim 25, wherein said convertor network is a diode array.

27. The switching device of claim 26, wherein said means for storing a portion of the energy of each said pulse of low voltage current comprises a second capacitor, said second capacitor being connected across first and second output leads of said diode array for storing a portion of the energy of each said pulse of low-voltage current which flows through said first capacitor, said second capacitor further being connected across supply voltage and ground pins of said 555 IC timer for supplying said stored energy to said 555 IC timer so as to operate said timer.

28. The switching device of claim 19, wherein said main relay comprises a triac.

29. The switching device of claim 19, wherein said main relay comprises an SCR.

* * * * *